US006481736B1

(12) United States Patent
Chan

(10) Patent No.: US 6,481,736 B1
(45) Date of Patent: Nov. 19, 2002

(54) RENEWABLE WHEELCHAIR AND GURNEY PROTECTION SYSTEM

(76) Inventor: Aaron Chan, 19571 Crystal Ridge La., Northridge, CA (US) 91326

( * ) Notice: Subject to any disclaimer, the term of this patent is extended or adjusted under 35 U.S.C. 154(b) by 0 days.

(21) Appl. No.: 09/898,767

(22) Filed: Jul. 2, 2001

(51) Int. Cl.[7] ..... A47G 9/00
(52) U.S. Cl. ..... 280/288.4; 297/229; 5/487
(58) Field of Search ..... 280/288.4, 304.3, 280/304.4, 304.5; 297/219.1, 291.11, 229; 5/487, 488, 81.1 C

(56) References Cited

U.S. PATENT DOCUMENTS 2,841,801 A * 7/1958 Crown et al. ..... 5/92
4,358,865 A * 11/1982 Pagel et al. ..... 5/81 B
4,676,376 A * 6/1987 Keiswetter ..... 206/494
4,993,091 A * 2/1991 Draper et al. ..... 5/487
5,084,927 A * 2/1992 Parkevich ..... 5/484
5,575,025 A * 11/1996 Peters ..... 5/600
5,718,009 A * 2/1998 Lin ..... 5/487

* cited by examiner

*Primary Examiner*—Daniel G. DePumpo
*Assistant Examiner*—Tony Winner
(74) *Attorney, Agent, or Firm*—Walter Unterberg

(57) ABSTRACT

A renewable protection system protects wheelchair and gurney users against diseases due to contacting contaminated surfaces with impervious sheet protectors—paper or plastic—covering all contact surfaces. Identical protectors separated by perforations form a roll from which they are detached for each successive user. The roll is placed in an openable storage tube with a protector dispensing slit. The storage tube is mounted detachably on wheelchair or gurney bottom frame bars. For a wheelchair, the protector is cruciform, with the crosspiece forming flaps extending over the sides of the wheelchair, and the longitudinal strip extending over the top of the back of the wheelchair. Four detachable adhesive stickers secure the protector to the wheelchair at the back and sides. For a gurney the protector has the width of the gurney platform and a length extending to the top of the headrest, to which the protector is attached by an open pocket.

9 Claims, 5 Drawing Sheets

FIG. 1
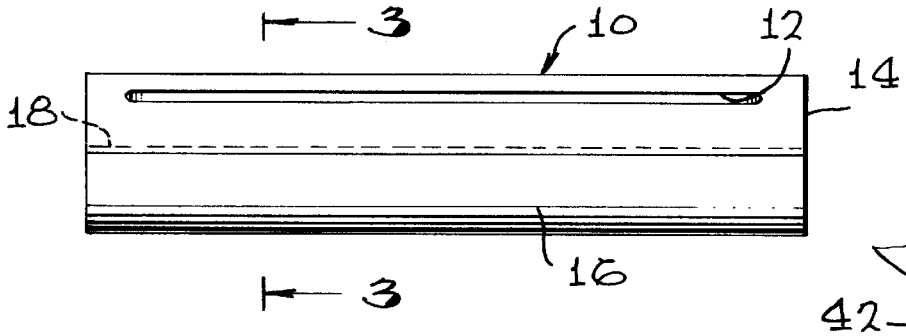
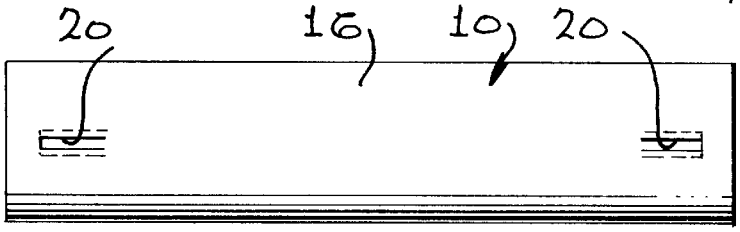
FIG. 2
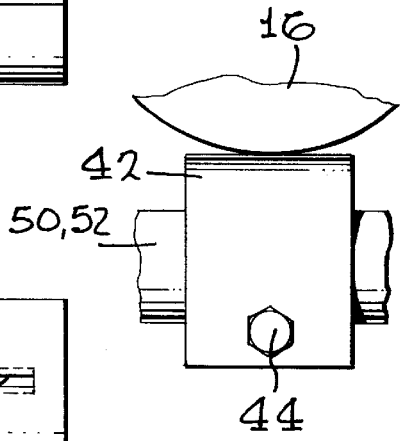
FIG. 8
FIG. 3
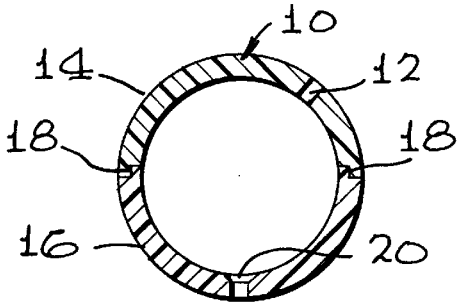
FIG. 5
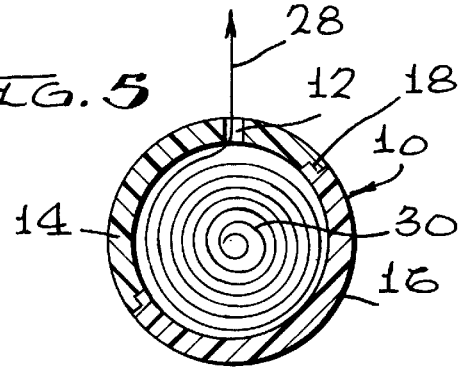
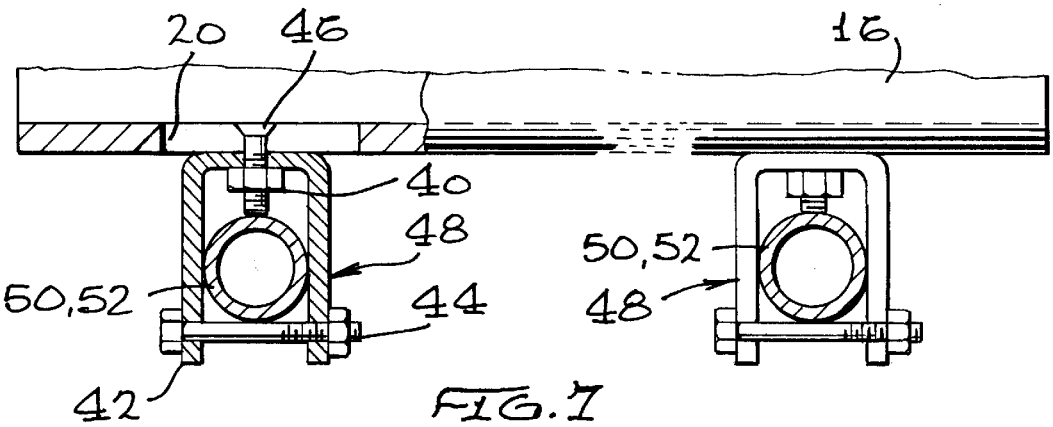
FIG. 7

32
36
12
48
10
38
52
K
M

RENEWABLE WHEELCHAIR AND GURNEY PROTECTION SYSTEM

BACKGROUND OF THE INVENTION—FIELD OF THE INVENTION

This invention relates to the protection of patients using wheelchairs and gurneys in hospitals, nursing homes and residences against diseases transmissible through contact with wheelchair and gurney surfaces. In particular, the invention relates to protective material layers interposed between such surfaces and the skin or apparel of patients sitting in wheelchairs or lying on gurneys.

BACKGROUND OF THE INVENTION—DISCUSSION OF RELATED ART

It has been observed that in many hospitals the most used transportation devices for patients, such as wheelchairs and gurneys, are never routinely washed or cleaned between patients. This means that there is an everpresent possibility of residual body fluids, such as blood and urine, or skin particles from one patient to adhere to wheelchair and gurney surfaces which come in contact with the next patient.

A layer of impermeable material interposed between the patient and the surfaces of the wheelchair or gurney will provide protection for the patient. Accordingly a search of U.S. patents in that field was undertaken.

Only patents for various wheelchair covers and shields for protection against surroundings and weather were found, as follows:

U.S. Pat No. 4,389,057 to Richard, Jr. (1983)

U.S. Pat No. 4,693,289 to Taylor et al (1987)

U.S. Pat No. 5,168,889 to Diestel (1992)

U.S. Pat No. 5,170,826 to Carstensen (1992)

U.S. Pat No. 5,921,258 to Francois (1999) and

D430,079 to Catron-Batts (2000).

No patents were found relating to protection of the patient against possible disease from contaminated surfaces of wheelchairs. Accordingly, the following objects for a protective interposed layer were developed.

OBJECTS OF THE INVENTION

1. To protect users of wheelchairs and patients on gurneys from health hazards.
2. To provide renewable protection for successive users and patients which is medically safe.
3. To provide protection which stays in place and cannot be slid off by users and patients as they enter or leave the wheelchair or gurney.
4. To provide protection which is disposable.
5. To provide protection which is inexpensive.
6. To provide protection which is easily installed; and
7. To provide protection which is straightforward to use.

SUMMARY OF THE INVENTION

To implement the objects stated above, the instant invention of the Renewable Wheelchair and Gurney Protection System has been devised. The basic concept is to provide a renewable protector made of a thin impermeable sheet material so shaped as to cover all the surfaces of a wheelchair or gurney which come in contact with a patient. The patient is thus isolated from the bare surfaces of the wheelchair or gurney. After use by one patient the used protector is discarded and replaced by a new protector.

To provide a fast renewable protection system for multiple users, an assembly of identical protectors is fabricated end-to-end into a continuous roll, with lateral perforations dividing one protector from the next for easy removal and renewal of protectors. Such a roll is analogous to the rolls of end-to-end plastic bags for fruits and vegetables in supermarkets.

The roll of protectors is placed inside a cylindrical protector storage tube with an axial slit through which the end-to-end protectors can be pulled out, one after the other. The tube, loaded with the roll of protectors, is then mounted horizontally across the bottom longitudinal frame of the wheelchair or gurney, underneath the seat of the wheelchair or platform of the gurney.

The tube is so positioned that each protector, when pulled out and up far enough, is exactly aligned to cover the seat or platform completely. Also, to anchor each protector, means are provided for the top of each protector to engage the top of the wheelchair or gurney, which avoids any possibility of the protector slipping off its conveyance and exposing the patient to a bare surface.

The embodiment shown here includes storage tube attachment assemblies which mount the storage tube detachably at two locations to a pair of parallel longitudinal bottom frame bars. In this way there is provided a portable wheelchair and gurney protection system which can be moved from one wheelchair or gurney to another. The renewable protection system thus consists of 1. a roll of end-to-end wheelchair or gurney protectors, 2. a protector roll storage tube, and 3. a pair of storage tube attachment assemblies.

For the wheelchair version the protector sheet reaches over the top of the back. The folded-over portion attaches to the rear of the wheelchair back by two adhesive back stickers, one near each lateral extremity. Also, two lateral flaps in the protector cover the left and right sides of the wheelchair and, further, extend over the sides. On each side an adhesive side sticker in the folded-over portion attaches the latter to the underside of the portion of the flap nearest the wheelchair occupant. For storage in the roll, the flaps are folded up toward the center, and later folded out for use.

For the gurney the protector is a straight longitudinal sheet covering the platform and headrest with an open pocket at its upper end fitting over the top of the headrest to anchor the protector.

The embodiment of the storage tube shown comprises two half-cylindrical shells detachably attached to each other to form the storage tube. The upper half-shell is detached to allow the protector roll to be loaded into the lower half-shell, with consecutive protectors pulled out through a dispensing slit in the upper half-shell, when the two half-shells are re-attached to each other to form the closed storage tube.

The lower half-shell incorporates two longitudinal attachment slots near its extremities at the bottom. The storage tube attach assemblies attach the lower half-shell through these slots to the pair of bottom frame bars of the wheelchair or gurney. In the embodiment shown here, each attach assembly comprises an inverted U-bracket with bolt holes through which bolt-and-nut connections attach the U-bracket to both the lower half-shell and the pair of bottom frame bars.

With the present embodiments or others to achieve the same functions, the invention of the Renewable Wheelchair and Gurney Protection System offers advantages which include:

1. Storage tubes with rolls of renewable impermeable sheet-like protectors can be easily attached and detached by means of simple attach assemblies;
2. Rolls of protectors can be easily removed from and replaced in the storage tubes;
3. Individual protectors are dimensioned to cover completely the surfaces which a patient would contact when using a wheelchair or gurney;
4. Protectors are kept in place by engaging components of the wheelchair or gurney and so cannot be slid off by users;
5. Used protectors can be separated from the roll at pre-designed perforations and disposed of;
6. Replacement protectors can be speedily pulled up from the roll for the next user; and
7. The total system of tube, roll, and attach assemblies is inexpensive to fabricate, simple to attach to and detach from a wheelchair or gurney, takes up little room and is portable.

BRIEF DESCRIPTION OF THE SEVERAL VIEWS OF THE DRAWING

A better understanding of the instant wheelchair and gurney protection invention may be gained by reference to the Detailed Description of the Invention which follows, in conjunction with several drawing figures showing the components of the interposing layer device as it is fitted to a wheelchair and a gurney.

In the drawing

FIG. 1 is an elevation and FIG. 2 is a bottom view of a protector roll storage tube;

FIG. 3 is a sectional end view of a protector roll storage tube taken on plane A—A in FIG. 2;

FIG. 4 is an elevation and FIG. 5 is a sectional end view of a protector roll storage tube loaded with a roll of wheelchair protectors, also showing a developed renewable wheelchair protector attached to the roll and pulled out of the storage tube;

FIG. 7 is a partly cross-sectional elevation and FIG. 8 is an end view of the storage tube and the two attach assemblies which attach the storage tube to a pair of bottom frame bars of a wheelchair or gurney;

DETAILED DESCRIPTION OF THE INVENTION

Figure 4:
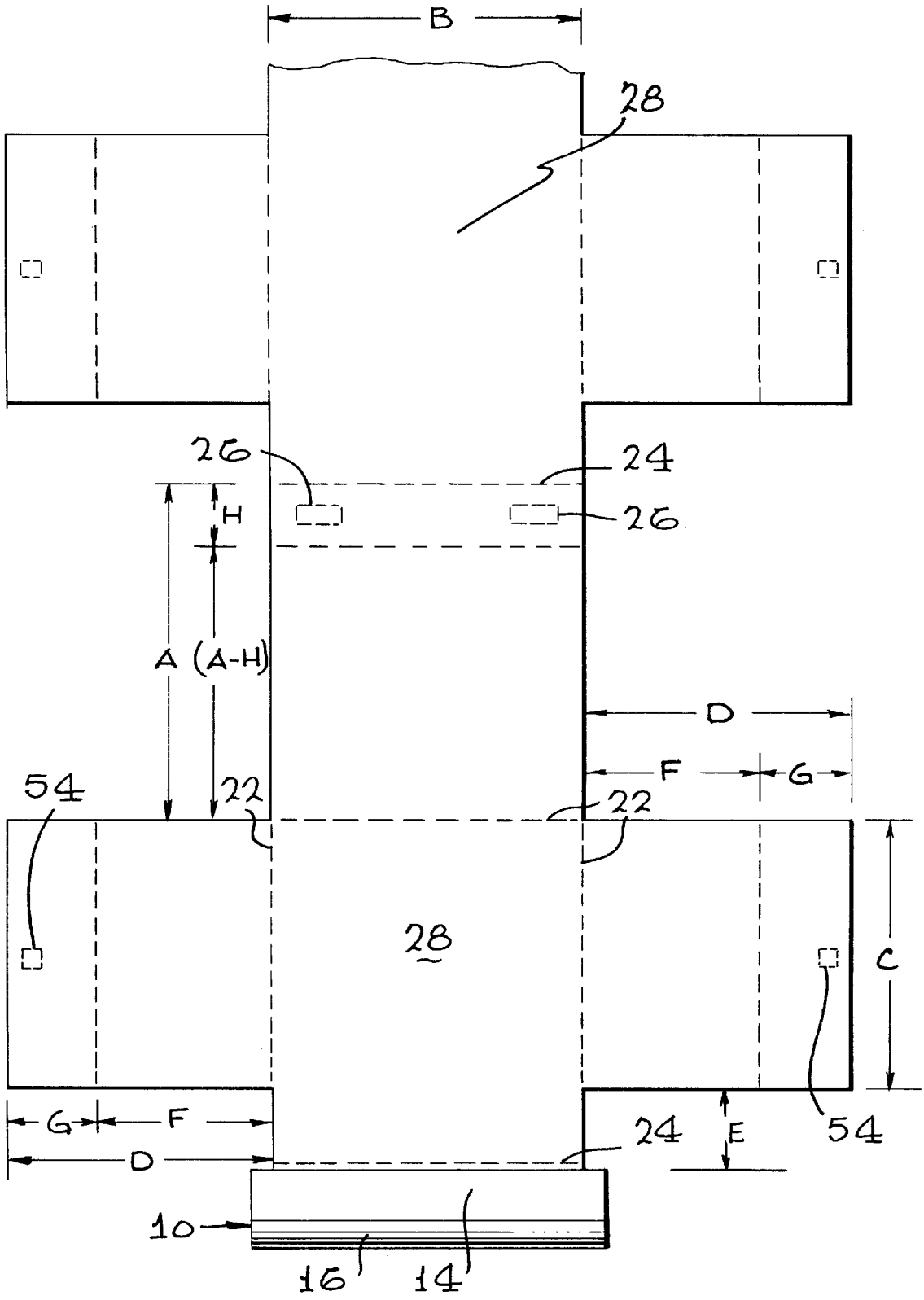

Referring now to FIG. 1, FIG. 2 and FIG. 3, three views of the protector roll storage tube 10 are shown. Tube 10 consists of an upper tube half-shell 14 and a lower tube half-shell 16, both provided with mating internal grooves 18 for attachment to each other to form closed storage tube 10. Upper half-shell 14 is detached from lower half-shell 16 to admit a roll of renewable protectors into the interior of lower half-shell 16, and then re-attached. Shells 14 and 16 are semi-cylindrical, with semi-circular solid ends.

Upper shell 14 comprises a dispensing slit 12 through which renewable protectors are pulled out. Lower shell 16 comprises two attachment slots for securing to the frame of a wheelchair or gurney. Half-shells 14 and 16 forming storage tube 10 are preferably made of a lightweight rigid material, such as plastic or aluminum.

Referring now to FIG. 4 and FIG. 5, storage tube 10 is shown loaded with a roll of wheelchair protectors 30, with a renewable wheelchair protector 28 pulled out of dispensing slit 12. Wheelchair protector 28 has perforations 24 at its extremities, enabling one protector 28 to be detached and disposed of after use. Then the next new protector 28 is pulled from roll 30 out of slit 12 and fitted to the wheelchair for the next use. The protectors 28 are made from a thin foldable sheet material such as paper or plastic.

FIG. 4 shows the shape of a developed wheelchair protector 28, laid out flat, with critical dimensions designated by letters A through H. Protector 28 is a rectangle of dimensions (A+C+E) long by B wide, with side flaps C long by D wide extending on either side. On the underside of the side flaps near their extremities are located adhesive side stickers 54, typically 1 inch square. When stored on roll 30 the side flaps are folded toward the center along fold lines 22 of length C. Contained within dimension A at its extremity is a length H for folding over the wheelchair back, with a pair of adhesive back stickers 26, typically 1 inch by 2 inch.

Typical protector dimensions for regular and extralarge wheelchairs are (in inches):

| | A | B | C | D | E | F | G | H |
|---|---|---|---|---|---|---|---|---|
| Regular | 23 | 17 | 15 | 16.5 | 6 | 11 | 6 | 2 |
| Extralarge | 22 | 23 | 11 | 17 | 11 | 11 | 6 | 2 |

Figure 6:
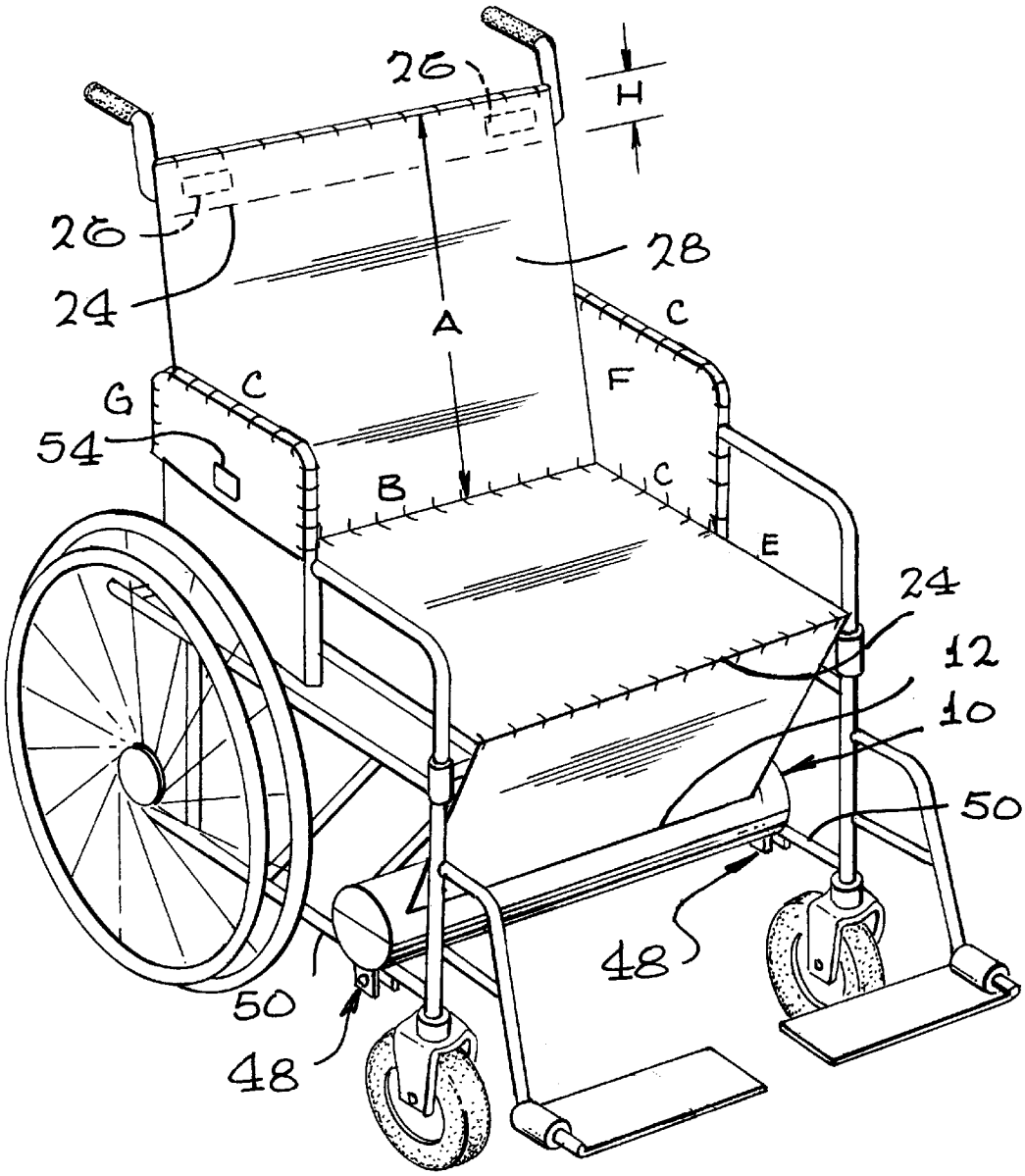
FIG. 6 is a pictorial view of a wheelchair with attached storage tube and a renewable wheelchair protector pulled out from the roll in the storage tube and in place on the wheelchair.

Referring now to FIG. 6, a wheelchair fitted with the invention is shown. Tube 10, loaded with roll 30, is attached through two attachment slots 20 (shown on FIG. 2 but not on FIG. 6) close to its axial extremities to a pair of wheelchair bottom frame bars 50 by means of two storage tube attach assemblies 48 (detailed on FIG. 7 and FIG. 8). A renewable wheelchair protector 28 extends upward through dispensing slit 12.

As seen on FIG. 6, the rectangle (C+E) by B covers the horizontal seat of the wheelchair. The two flaps are folded outward over the left and right sides of the wheelchair, forming on either side an inside rectangle F by C, and an outside rectangle G by C, where F+G=D. The outside rectangle is secured to the inside rectangle by adhesive side sticker 54.

The vertical back of the wheelchair is covered by a rectangle (A–H) long by B wide, with a portion H long by B wide folded over the back. Protector 28 is finally secured to the wheelchair by attaching the pair of adhesive back stickers 26 in the folded-over portion (B by H) to the rear of the wheelchair back.

Thus all wheelchair surfaces which come into contact with a patient are covered by a renewable wheelchair protector 28. After use a protector 28 is detached from roll 30 at perforation 24 for disposal. A new unused protector 28 is then pulled out of slit 12 from roll 30 and attached to the wheelchair by handle holes 26, ready for the next use.

Referring now to FIGS. 7 and FIG. 8, details of the two storage tube attach assemblies 48 are shown. Each assembly 48 attaches tube via an attachment slot 20 in lower half-shell 16 to one of a pair of horizontal wheelchair bottom frame bars 50 (as in FIG. 6) or of a pair of horizontal gurney bottom frame bars 52 (as in FIG. 11).

The main component of assembly 48 is an inverted U-bracket 42 with a central bolt hole at the top of the 'U' to accommodate nut-and-bolt fastening 40 which secures U-bracket 42 to tube 10 through attachment slot 20 in lower tube shell 16. With tube 10 loosely attached to the two U-brackets 42, these are now lowered in place over the pair of lower frame bars 50 or 52. Slotted bolts 46 are kept loose enough in fastenings 40 to permit U-brackets 42 to slide horizontally in attachment slots 20 to accommodate the horizontal distance between the bars of pair 50 or 52.

Once in place over bar pair 50 or 52, slotted chamfered bolts are tightened with a screwdriver to firmly attach U-brackets 42 to tube 10. Lastly, U-brackets 42 are tightened on bar pair 50 or 52 by closures 44, here shown in the form of nut-and-bolt fasteners. Tightening closure 44 produces friction between the inner walls of U-bracket 42 and the outer wall of a bar 50 or 52 to keep tube 10 firmly in position. Upper tube shell 14 can then be detached and the applicable roll of protectors can be loaded into lower tube shell 16, after which shell 14 is re-attached.

Figure 9:
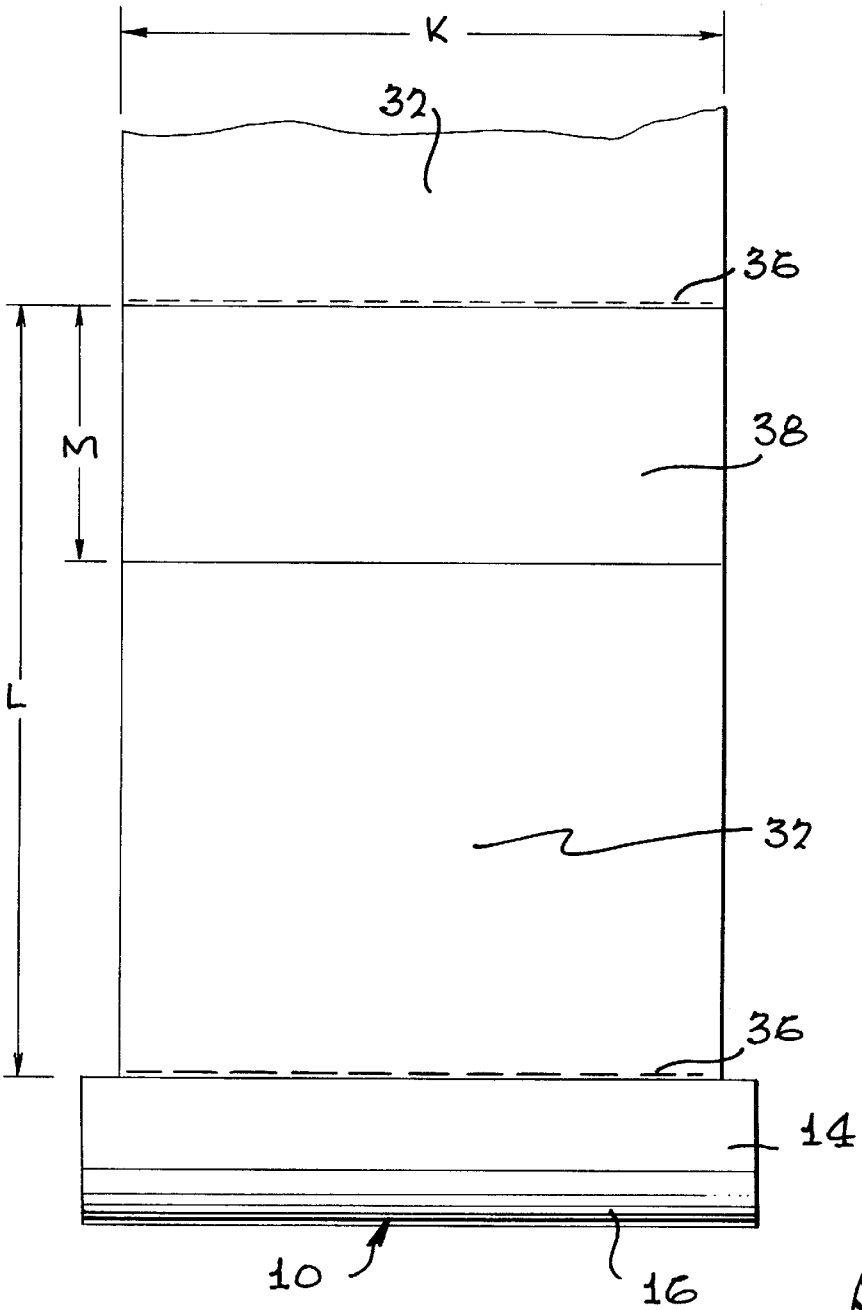
FIG. 9 is an elevation and FIG. 10 is a sectional end view of a protector roll storage tube loaded with a roll of gurney protectors, also showing a developed gurney protector attached to the roll and pulled out of the storage tube.
Figure 10:
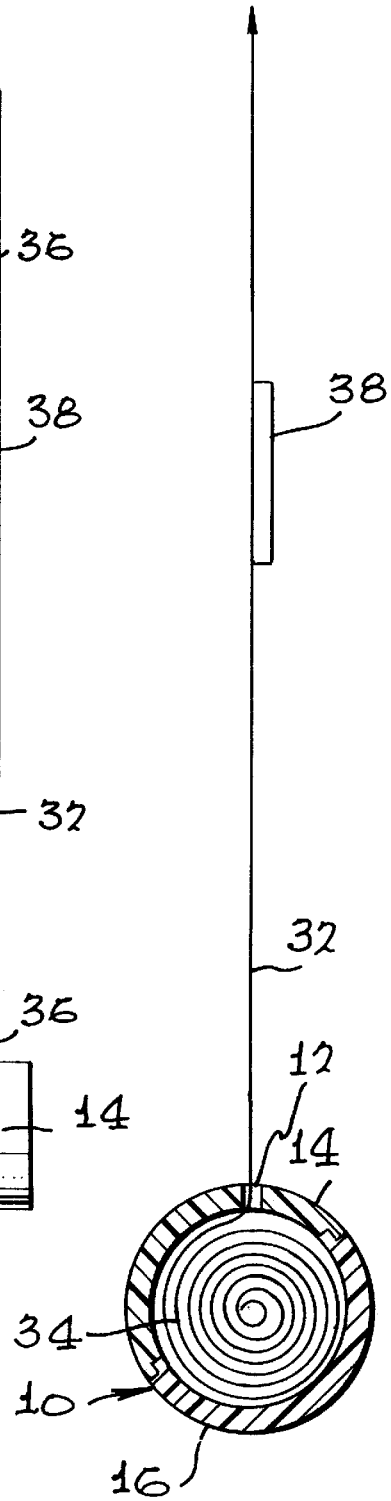

Referring now to FIGS. 9 and FIG. 10, tube 10 and a gurney protector 32 (dimensions K,L,M), attached to roll of gurney protectors 34, extending from dispensing slit 12 in upper shell 14 of tube 10 are shown. Each protector 32 is rectangular in shape, of width K and length L, with an open pocket 38 of length M, and separated from its neighbor by perforations 36.

| K = 25 | L = 74 | M = 10 |
|---|---|---|

Figure 11:
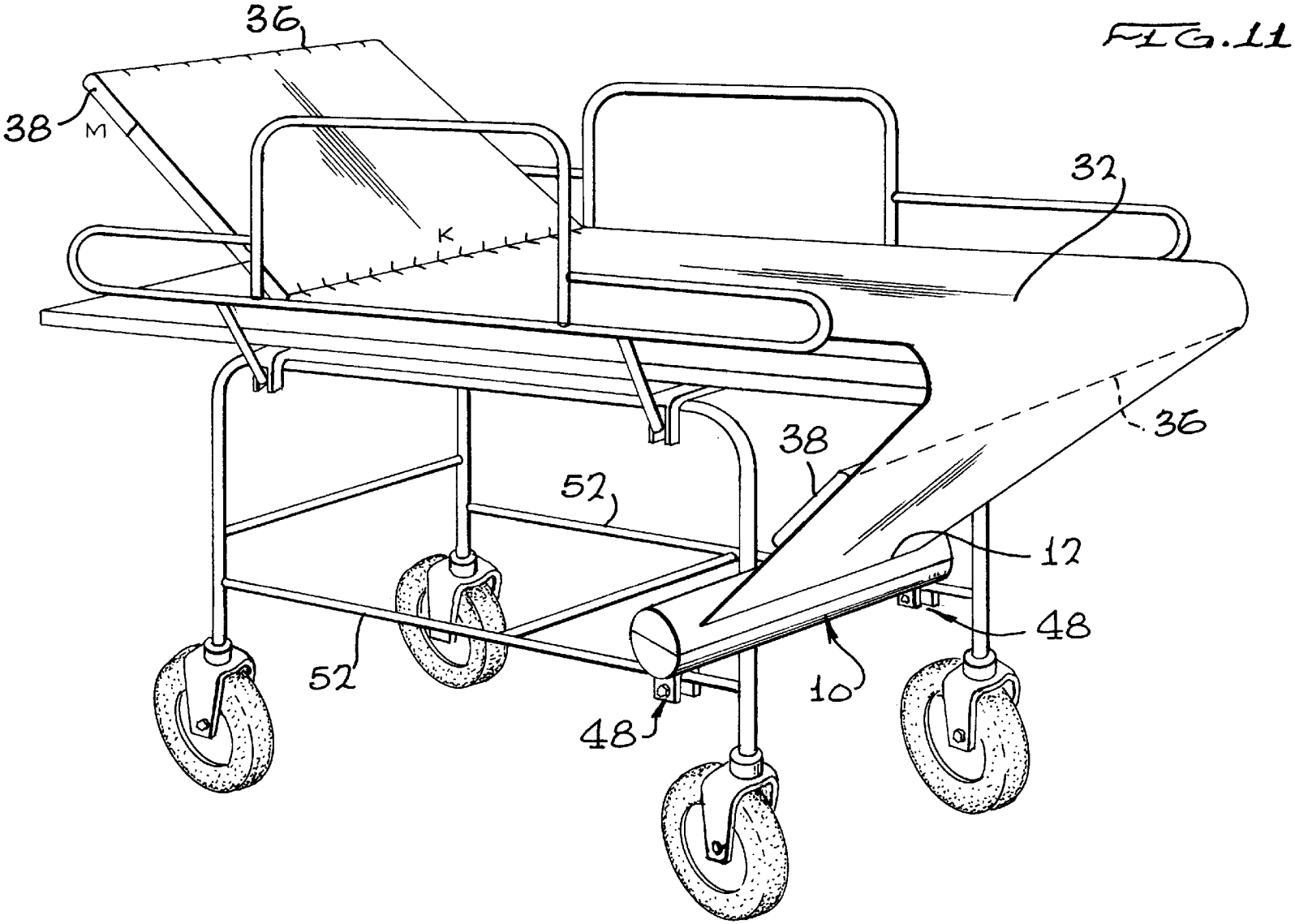
FIG. 11 is a pictorial view of a gurney with attached storage tube and a renewable gurney protector pulled out from the roll in the storage tube and in place on the gurney.

Referring now to FIG. 11, a pictorial view is shown of a gurney with tube 10 attached and a gurney protector 32 extending from tube 10 through slit 12 and in place on the gurney. Tube 10 is attached to a pair of gurney bottom frame bars 52 by means of two storage tube attach assemblies 48, as detailed in FIGS. 7 and 8. The width K of protector 32 is indicated, as is open pocket 38, also shown in FIGS. 9 and 10, which fits over the top of the head rest portion of the gurney to anchor the top of protector 32. Perforations in gurney roll 36 are provided at the longitudinal extremities of each protector 32 to separate it from its neighbors and to facilitate removal and renewal of protectors.

The invention described above in detail meets the objects stated earlier, with the main aim of completely protecting patients in wheelchairs and on gurneys from any health hazards which could arise when patients are in contact with the bare surfaces of these conveyances. Specific advantages of the invention include:

1. Storage tubes with rolls of renewable sheet-like protectors can be easily attached to and detached from wheelchair and gurney frames by means of simple attach assemblies;
2. Individual protectors are dimensioned to cover completely the surfaces which a patient would contact when using a wheelchair or gurney;
3. Protectors are kept in place during normal use on and wheelchair by adhesive stickers (which can later be detached), and on a gurney by a protector pocketand;
4. Used protectors can be easily separated from wheelchair or gurney, and from the roll at pre-designed perforations for disposal;
5. Replacement protectors are speedily pulled up from the roll for the next user; and
6. The total system of tube, roll, and attach assemblies is inexpensive to fabricate, simple to attach and detach from a wheelchair or gurney, takes up little room, and is portable.

It is to be understood that the invention may be realized with embodiments differing from the specific apparatus illustrated herein without departing from the scope of the present invention as delineated in the following claims.

I claim:

1. A renewable wheelchair protection system for protecting wheelchair users against diseases transmitted by contact with wheelchair surfaces, said wheelchair protection system comprising:

a protector roll storage tube of split construction detachably attached to a lower portion of a wheelchair by means of a storage tube attach assembly, said storage tube having a dispensing slit; and a roll of impervious identical wheelchair protectors in series, one said wheelchair protector separable from the next, placed inside said storage tube, with a first wheelchair protector at a free end of said roll pulled up through said dispensing slit and out of said storage tube to cover a seat, two sides and a back of said wheelchair, said first wheelchair protector being detachably secured to said two sides and said back by wheelchair attach means;

whereby a first wheelchair user is completely isolated from normally contacted wheelchair surfaces;

whereby after departure of said first wheelchair user said first wheelchair protector is (a) separated from a contiguous second wheelchair protector on said roll, then (b) removed from said wheelchair by detaching said wheelchair attach means, and (c) placed in a suitable trash container;

whereby in preparation for a second wheelchair user said second wheelchair protector is now pulled up through said dispensing slit and out of said storage tube to cover said seat, said two sides and said back of said wheelchair, said second wheelchair protector being detachably secured to said two sides and said back by said wheelchair attach means to completely isolate a second wheelchair user from normally contacted wheelchair surfaces; and whereby similarly a third, fourth and so on said wheelchair protector is pulled up through said dispensing slit and out of said storage tube to securely cover in a similar manner said seat, said two sides and said back of said wheelchair to completely isolate a third, fourth and so on wheelchair user from normally contacted wheelchair surfaces.

2. The wheelchair protection system of claim 1 wherein said storage tube is made of rigid plastic material.

3. The wheelchair protection system of claim 1 wherein said impervious wheelchair protectors are made of thin plastic sheet material.

4. The wheelchair protection system of claim 1 wherein said impervious wheelchair protectors are made of thin paper sheet material.

5. The wheelchair protection system of claim 1 wherein said storage tube split construction comprises an upper tube half shell and a lower tube half shell, both provided with mating internal shell grooves for opening up said storage tube and loading with said roll of wheelchair protectors and subsequent closing, said upper tube half shell accommodating said dispensing slit, and said lower tube half shell accommodating a pair of attachment slots.

6. The wheelchair protection system of claim 5 wherein said lower portion of a wheelchair is a pair of wheelchair bottom frame bars, and said storage tube attach assembly comprises (a) a pair of nut-and-bolt fastenings connecting said lower tube half shell pair of attachment slots to (b) a pair of U-brackets embracing said pair of wheelchair bottom frame bars, and (c) a pair of closure bolts firmly securing said pair of U-brackets to said pair of bottom frame bars, whereby said storage tube may be attached and detached from said pair of wheelchair bottom frame bars.

7. The wheelchair protection system of claim 1 wherein a common edge between said first wheelchair protector and a contiguous said second wheelchair protector in said roll is a lateral linear perforation which is torn end to end to separate aid first wheelchair protector from said second wheelchair protector.

8. The wheelchair protection system of claim 1 wherein said impervious identical wheelchair protectors are flat cruciform sheets with a longitudinal dimension extending from said dispensing slit over said seat, up to a top of said back and down an exterior of said back, with a width equal to a width of said seat; and a lateral dimension extending from an exterior of a first wheelchair side over a top of said first side, down the interior of said first side, across said seat, up an interior of a second wheelchair side, and over a top of said second side to an exterior of said second side, with a width equal to a length of said seat;

whereby said exterior portions on said first side and on said second side of said lateral dimension , designated a first flap and a second flap, are folded inward when rolling up a virgin said roll of said wheelchair protectors to form a constant width said roll for storage in said storage tube.

9. The wheelchair protection system of claim 8 wherein said wheelchair attach means are four detachable adhesive stickers:

two back stickers attaching said terminal exterior back portion of said longitudinal dimension of said wheelchair protector to a rear of said wheelchair back;

a first side sticker attaching said first flap from said exterior of said first wheelchair side through an open portion of said first side to a portion of said lateral dimension protector on said interior of said first side; and a second side sticker attaching said second flap from said exterior of said second wheelchair side through an open portion of said second side to a portion of said lateral dimension protector on said interior of said second side.

* * * * *